US005599474A

United States Patent [19]

Weiss et al.

[11] Patent Number: 5,599,474

[45] Date of Patent: Feb. 4, 1997

[54] TEMPERATURE INDEPENDENT MAGNETORHEOLOGICAL MATERIALS

[75] Inventors: Keith D. Weiss; J. David Carlson, both of Cary; Theodore G. Duclos, Holly Springs; Kirk J. Abbey, Raleigh, all of N.C.

[73] Assignee: Lord Corporation, Cary, N.C.

[21] Appl. No.: 229,270

[22] Filed: Apr. 18, 1994

Related U.S. Application Data

[63] Continuation-in-part of Ser. No. 968,735, Oct. 30, 1992, abandoned.

[51] Int. Cl.[6] ..... H01F 1/44

[52] U.S. Cl. ..... 252/62.52; 252/62.54; 252/62.56

[58] Field of Search ..... 252/62.52, 62.54, 252/62.56, 74, 75

[56] References Cited

U.S. PATENT DOCUMENTS

| | | | |
|---|---|---|---|
| Re. 32,573 | 1/1988 | Furumura et al. | 252/62.52 |
| 2,575,360 | 11/1951 | Rabinow . | |
| 2,661,596 | 12/1953 | Winslow . | |
| 2,661,825 | 12/1953 | Winslow . | |
| 2,663,809 | 12/1953 | Winslow . | |
| 2,667,237 | 1/1954 | Rabinow . | |
| 2,670,749 | 3/1954 | Gemer . | |
| 2,733,792 | 2/1956 | Saxl . | |
| 2,751,352 | 6/1956 | Bondi | 252/62.52 |
| 2,847,101 | 8/1958 | Bergmann | 252/62.52 |
| 2,886,151 | 5/1959 | Winslow . | |
| 3,010,471 | 11/1961 | Gross . | |
| 3,700,595 | 10/1972 | Kaiser | 252/62.52 |
| 3,764,540 | 10/1973 | Khalafalla et al. | 252/62.52 |
| 3,917,538 | 11/1975 | Rosensweig | 252/62.52 |
| 4,356,098 | 10/1982 | Chagnon | 252/62.51 |
| 4,824,587 | 4/1989 | Kwon et al. | 252/62.54 |
| 4,976,883 | 12/1990 | Kanno et al. | 252/62.52 |
| 4,992,190 | 2/1991 | Shtarkman | 252/62.52 |
| 5,007,513 | 4/1991 | Carlson | 252/62.52 |
| 5,013,471 | 5/1991 | Ogawa | 252/62.52 |
| 5,143,637 | 9/1992 | Yokouchi et al. | 252/62.52 |
| 5,147,573 | 9/1992 | Chagnon | 252/61.51 |
| 5,167,850 | 12/1992 | Shtarkman | 252/62.52 |
| 5,382,373 | 1/1995 | Carlson et al. | 252/62.55 |

FOREIGN PATENT DOCUMENTS

| | | |
|---|---|---|
| 162371 | 10/1952 | Australia . |
| 406692 | 1/1991 | European Pat. Off. . |
| 63-175401 | 7/1988 | Japan . |

OTHER PUBLICATIONS

*Technical News Bulletin,* vol. 32, No. 5, pp. 54–60, U.S. Dept. of Commerce (May 1948) (describes magnetic clutch developed at National Bureau of Standards by J. Rabinow). Kirk–Othmer Encyclopedia of Chemical Technology, vol. 14, pp. 662–664 (1981) (Month Unknown).

*Primary Examiner*—Prince Willis, Jr.
*Assistant Examiner*—Alan D. Diamond
*Attorney, Agent, or Firm*—Wayne W. Rupert

[57] ABSTRACT

A magnetorheological material containing a particle component and a carrier fluid or mixture of carrier fluids having a change in viscosity per degree temperature ($\Delta\eta/\Delta T$ ratio) less than or equal to about 16.0 centipoise/°C. over the temperature range of about 25° C. to –40° C. The magnetorheological material exhibits a substantial magnetorheological effect and excellent lubricating properties with a minimal variation in mechanical properties with respect to changes in temperature. The magnetorheological material is advantageous in that it provides for the design of devices that are smaller, more efficient and consume less power.

26 Claims, 4 Drawing Sheets

TEMPERATURE INDEPENDENT MAGNETORHEOLOGICAL MATERIALS

This is a continuation-in-part of application Ser. No. 07/968,735 filed on Oct. 30, 1992 now abandoned.

FIELD OF THE INVENTION

The present invention relates to certain fluid materials which exhibit substantial increases in flow resistance when exposed to magnetic fields. More specifically, the present invention relates to low viscosity magnetorheological materials that substantially minimize the variance in force required by a magnetorheological device over a given temperature range.

BACKGROUND OF THE INVENTION

Fluid compositions which undergo a change in apparent viscosity in the presence of a magnetic field are commonly referred to as Bingham magnetic fluids or magnetorheological materials. Magnetorheological materials normally are comprised of ferromagnetic or paramagnetic particles, typically greater than 0.1 micrometers in diameter, dispersed within a carrier fluid and in the presence of a magnetic field, the particles become polarized and are thereby organized into chains of particles within the fluid. The chains of particles act to increase the apparent viscosity or flow resistance of the overall material and in the absence of a magnetic field, the particles return to an unorganized or free state and the apparent viscosity or flow resistance of the overall material is correspondingly reduced. These Bingham magnetic fluid compositions exhibit controllable behavior similar to that commonly observed for electrorheological materials, which are responsive to an electric field instead of a magnetic field.

Both electrorheological and magnetorheological materials are useful in providing varying damping forces within devices, such as dampers, shock absorbers and elastomeric mounts, as well as in controlling torque and or pressure levels in various clutch, brake and valve devices. Magnetorheological materials inherently offer several advantages over electrorheological materials in these applications. Magnetorheological fluids exhibit higher yield strengths than electrorheological materials and are, therefore, capable of generating greater damping forces. Furthermore, magnetorheological materials are activated by magnetic fields which are easily produced by simple, low voltage electromagnetic coils as compared to the expensive high voltage power supplies required to effectively operate electrorheological materials. A more specific description of the type of devices in which magnetorheological materials can be effectively utilized is provided in U.S. Pat. Nos. 5,284,330 and 5,277,281.

Magnetorheological or Bingham magnetec fluids are distinguishable from colloidal magnetic fluids or ferrofiuids. In colloidal magnetic fluids the particles are typically 0.005 to 0.01 micrometers in diameter. Upon the application of a magnetic field, a colloidal ferrofiuid does not exhibit particle structuring or the development of a resistance to flow. Instead, colloidal magnetic fluids-experience a body force on the entire material that is proportional to the magnetic field gradient. This force causes the entire colloidal ferrofiuid to be attracted to regions of high magnetic field strength.

Magnetorheological fluids and corresponding devices have been discussed in various patents and publications. For example, U.S. Pat. No. 2,575,360 provides a description of an electromechanically controllable torque-applying device that uses a magnetorheological material to provide a drive connection between two independently rotating components, such as those found in clutches and brakes. A fluid composition satisfactory for this application is stated to consist of 50% by volume of a soft iron dust, commonly referred to as "carbonyl iron powder", dispersed in a suitable liquid medium such as a light lubricating oil.

Another apparatus capable of controlling the slippage between moving parts through the use of magnetic or electric fields is disclosed in U.S. Pat. No. 2,661,825. The space between the moveable parts is filled with a field responsive medium. The development of a magnetic or electric field flux through this medium results in control of resulting slippage. A fluid responsive to the application of a magnetic field is described to contain carbonyl iron powder and light weight mineral oil (2–10 centipoise).

U.S. Pat. No. 2,886,151 describes force transmitting devices, such as clutches and brakes, that utilize a fluid film coupling responsive to either electric or magnetic fields. An example of a magnetic field responsive fluid is disclosed to contain reduced iron oxide powder and a lubricant grade oil having a viscosity of from 2 to 20 centipoises at 25° C.

The construction of valves useful for controlling the flow of magnetorheological fluids is described in U.S. Pat. Nos. 2,670,749 and 3,010,471. The magnetic fluids applicable for utilization in the disclosed valve designs include ferromagnetic, paramagnetic and diamagnetic materials. A specific magnetic fluid composition spedfled in U.S. Pat. No. 3,010,471 consists of a suspension of carbonyl iron in a light weight hydrocarbon oil. Magnetic fluid mixtures useful in U.S. Pat. No. 2,670,749 are described to consist of a carbonyl iron powder dispersed in either a silicone oil or a chlorinated or fiuorinated suspension fluid.

Various magnetorheological material mixtures are disclosed in U.S. Pat. No. 2,667,237. The mixture is defined as a dispersion of small paramagnetic or ferromagnetic particles in either a liquid, coolant, antioxidant gas or a semi-solid grease. A preferred composition for a magnetorheological material consists of iron powder and light machine off. A specifically preferred magnetic powder is stated to be carbonyl iron powder with an average particle size of 8 micrometers. Other possible carrier components include kerosene, grease, and silicone oil.

U.S. Pat. Nos. 4,992,190 and 5,167,850 disclose rheological materials that are responsive to a magnetic field. The composition of these materials are disclosed to be either magnetizable particles and silica gel or carbon fibers dispersed in a liquid carrier vehicle. The magnetizable particles can be powdered magnetite or carbonyl iron powders with insulated reduced carbonyl iron powder, such as that manufactured by GAF Corporation, being specifically preferred. The liquid-carrier vehicle is described as having a viscosity in the range of 1 to 1000 centipoises at 100° F. Specific examples of suitable vehicles include Conoco LVT oil, kerosene, light paraffin oil, mineral oil, and silicone oil. A preferred carrier vehicle is silicone oil having a viscosity in the range of about 10 to 1000 centipoise at 100° F.

U.S. Pat. No. 2,751,352 and Australian Patent Specification 162,371 discloses magnetorheological fluids wherein the magnetic particles are inhibited from precipitating or settling out of the fluid system. The inhibition of particle settling is accomplished by the addition of a minute amount of an oleophobic material to the magnetic fluid. Examples of these oleophobic materials include ethyl alcohol, propyl alcohol, glycerol, ethylene glycol, propylene glycol and ethlyene diamine. The base carrier or vehicle for the magnetic particles is stated to be selected from a wide variety of materials preferably oleaginous in character. Examples of the base carrier or vehicle include mineral oils (40 to 2,000 SUS at 100° F.); synthetic lubricants produced by the Fischer-Tropsch, Synthol, Synthine, Berguis, and Voltolization processes; organic synthetic lubricants; synthetic lubricants made by the polymerization of alkylene oxides at elevated temperatures in the presence of catalysts (i.e., iodine, hydrogen iodide, etc.); polymers obtained from oxygen-containing heterocyclic compounds; silicone compounds; and fluoro and/or chloro carbon oils. While most of the base carriers or vehicles are only described as general classes of materials, specific compounds listed as carrier vehicles include light machine oil having a viscosity between 300 to 700 SUS at 100° F., di(2-ethylhexyl) sebacate, di(2-ethylhexyl) adipate, ethyl ricinoleate, tricresyl phosphate, trioctyl phosphate, dibutyl trichloromethanephosphonate, trixylenyl phosphate, tributyl phosphate, triethyl phosphate, tetraphenyl silicate, tetra ethyl hexyl silicate, kerosene, and hexachlorobutadiene.

It is desirable that the continous component or carrier fluid of a magnetorheological material exhibit several basic characteristics. These characteristics include: (a) chemical compatibility with both the particle component of the fluid and device materials; (b) relatively low cost; (c) low thermal expansion; (d) high density and (e) excellent lubricity. Magnetorheological materials should also be non-hazardous to the surrounding environment and, more importantly, be capable of functioning consistently over a broad temperature range.

Most of the carrier fluid components that are traditionally used in magnetorheological materials as previously described cannot adequately meet all of these basic requirements. For instance, many of the previously described magnetorheological materials cause large variations in the force exhibited by a magnetorheological device utilizing the materials over a broad temperature range. In addition, many of these traditional magnetorheological materials provide inadequate lubricating properties between device components. Hence, many of the magnetorheological materials prepared with traditional carrier fluids limit either the useful life of a device through excessive wear or the temperataure range over which the device can be used. Conventional magnetorheological materials cannot be effectively utilized in automotive and aerospace damping devices and the like which require consistent application of precisely controlled force over widely varying temperatures.

Characterization of the performance of magnetorheological materials with respect to a change in operating temperature is vital to the successful commercialization of most magnetorheological devices, such as clutches, brakes, dampers, shock absorbers and engine mounts. All of these devices inherently experience a variation in operating temperature over their lifetime. For instance, specifications for automotive and aerospace applications typically require the device to operate at or survive exposure to temperatures ranging from about −40° C. to 150° C.

A need therefore exists for magnetorheological materials that are lubricating in nature and exhibit limited variation in properties over a broad temperature range.

SUMMARY OF THE INVENTION

The present invention is a magnetorheological material which exhibits a substantial magnetorheological effect, excellent lubricity, and a minimal variation in mechanical properties with respect to changes in temperature. More specifically, the present invention relates to a magnetorheological material comprising a carrier fluid and a particle component wherein the carrier fluid has a change in viscosity ($\eta$) per degree temperature (T) ($\Delta\eta/\Delta T$ ratio) less than or equal to about 16.0 centipoise/°C. over the temperature range of about 25° C. to −40° C.

It has presently been discovered that carrier fluids having a $\Delta\eta/\Delta T$ ratio less than or equal to about 16.0 centipoise/°C. over the temperature range of 25° to −40° C. can be utilized to prepare magnetorheological materials which have an unusually low variance of mechanical properties over a broad temperature range. Conventional carrier fluids, typically, have either a $\Delta\eta/\Delta T$ ratio greater than the limit described above or poor lubricating properties and are therefore unacceptable for utilization in a device over an extended period of time or a broad temperature range. Carrier fluids that exhibit the necessary $\Delta\eta/\Delta T$ ratio and lubricating properties for purposes of the invention have presently been found to exist sporadically within several major classes or groups of lubricating oils, such as unsaturated hydrocarbon oils; monobasic acid esters; glycol esters and ethers, fluorinated esters and ethers; silicate esters; silicone oils; and halogenated hydrocarbons. Various mixtures of lubricating oils have also presently been discovered to exhibit the necessary $\Delta\eta/\Delta T$ ratio and lubricating properties required by the present invention. Magnetorheological materials utilizing the carrier fluids of the present invention when utilized in a device, such as a damper, mount or clutch, exhibit excellent lubricating properties and significantly less variation in the force output over a temperature range from about −40° to 150° C. as compared to devices using magnetorheological materials prepared with traditional carrier fluids.

BRIEF DESCRIPTION OF THE DRAWINGS

In FIG. 1 the force data obtained using a low viscosity magnetorheological material of the present invention (Example 44) is contrasted against data obtained with this damper under similar conditions using a comparative magnetorheological material (Example 45).

In FIG. 2 the force data obtained using a low viscosity magnetorheological material of the present invention (Example 46) is contrasted against data obtained with this damper under similar conditions using a comparative magnetorheological material (Example 49).

In FIG. 3 the force data obtained using a low viscosity magnetorheological material of the present invention (Example 47) is contrasted against data obtained with this damper under similar conditions using a comparative magnetorheological material (Example 50).

In FIG. 4 the force data obtained using a low viscosity magnetorheological material of the present invention (Example 48) is contrasted against data obtained with this damper under similar conditions using a comparative magnetorheological material (Example 51).

DETAILED DESCRIPTION OF THE INVENTION

Figure 1:
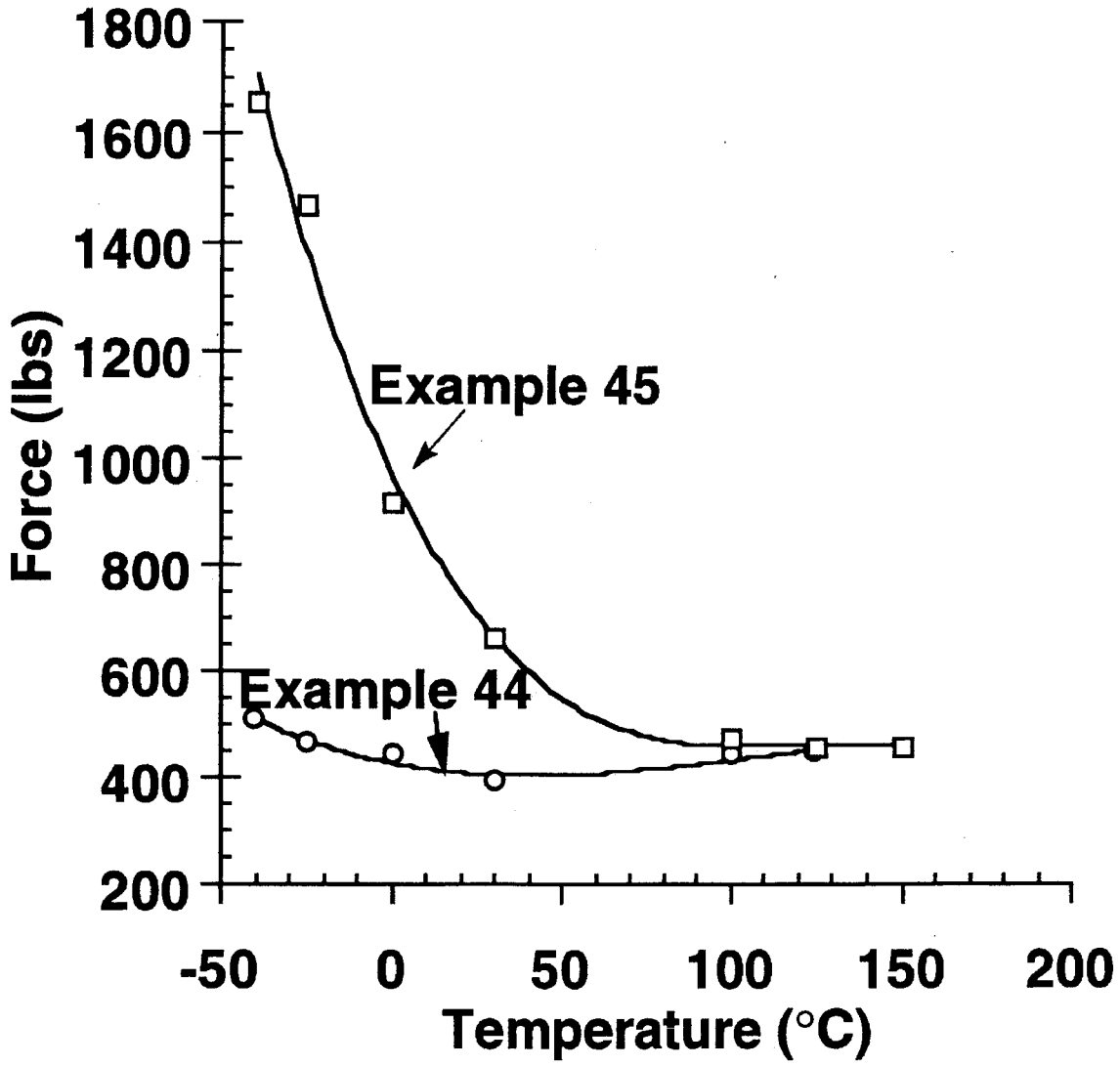
FIGS. 1–4 show the force output for a linear magnetorheological damper plotted as a function of temperature. The force data obtained for this damper at a magnetic field of about 1000 Oersted is measured over the temperature range of −40° to 150° C.

The magnetorheological material of the present invention comprises a carrier fluid and a particle component wherein the carrier fluid has a change in viscosity per degree temperature $\Delta\eta/\Delta T$ ratio over the temperature range of about 25° C. to −40° C. less than or equal to about 16.0 centipoise/°C., preferably less than or equal to about 9.0 centipoise/°C., with less than or equal to about 7.0 centipoise/°C. being especially preferred. As utilized herein, the term "appropriate $\Delta\eta/\Delta T$ ratio" refers to a $\Delta\eta/\Delta T$ ratio over the temperature range of about 25° C. to −40° C. that is less than or equal to about 16.0 centipoise/°C.

Carrier fluids having an appropriate $\Delta\eta/\Delta T$ ratio for purposes of the present invention may be found to sporadically exist in any of the known classes of oils or liquids with the exception of (a) natural fatty oils, (b) mineral oils, (c) polyphenylethers, (d) dibasic acid esters, (e) neopentylpolyol esters, (f) phosphate esters, and (g) synthetic cycloparaffins and synthetic paraffins. The known liquids that are classified within these six broad classes of liquids either do not exhibit the necessary $\Delta\eta/\Delta T$ ratio, as exemplified by groups (a) through (e) or do not exhibit the lubricating properties necessary to satisfactorily be utilized in a magnetorheological fluid device, such as a damper, operated over a broad temperature range, as exemplified by groups (f) and (g).

The classes of oils or liquids in which a cartier fluid having an appropriate $\Delta\eta/\Delta T$ ratio for purposes of the present invention may be found to sporadically exist include (h) unsaturated hydrocarbon oils; (i) monobasic acid esters; (j) glycol esters and ethers, (k) fluorinated esters and ethers; (1) silicate esters; (m) silicone oils; and (n) halogenated hydrocarbons, as well as mixtures and derivatives thereof. A carrier fluid mixture appropriate to the present invention will always be obtained independent of the amounts of each fluid present in the mixture when each fluid independently exhibits an appropriate $\Delta\eta/\Delta T$ ratio and is selected from the classes (h) through (n). The preferred carrier fluids or carrier fluid mixtures of the present invention are selected from the classes (h), (j), (k), and (m). Although a large number of carrier fluids are classified within each of these broad classes, only a very limited number of these carrier fluids will exhibit the appropriate $\Delta\eta/\Delta T$ ratio and therefore are appropriate for use in the present invention. Carrier fluids having a $\Delta\eta/\Delta T$ ratio suitable for use in the present invention and falling within the classes (h) through (n) above are hereinafter collectively referred to as Group I carrier fluids. It should be noted that all fluids falling within classes (h) through (n) have lubricating properties suitable for purposes of the present invention regardless of the value of their $\Delta\eta/\Delta T$ ratios.

A limited number of carrier fluid mixtures having an appropriate $\Delta\eta/\Delta T$ ratio and necessary lubricating properties may also be obtained by mixing specific amounts of Group I carrier fluids decribed above that exhibit the appropriate $\Delta\eta/\Delta T$ ratio with carrier fluids from classes (a) through (n) that are outside the scope of present invention in that they do not exhibit an appropriate $\Delta\eta/\Delta T$ ratio or do not possess adequate lubricating properties. Carrier fluids falling within the classes of (a) through (n) above that do not exhibit an appropriate $\Delta\eta/\Delta T$ ratio or do not possess adequate lubricating properties for purposes of the invention are hereinafter collectively referred to as Group II carrier fluids. This particular mixture is hereinafter described as a primary fluid mixture. The specific amounts of each fluid added to prepare this primary fluid mixture is dependent upon the magnitude of the individual $\Delta\eta/\Delta T$ ratios and lubricating properties exhibited by each fluid. In general, a primary fluid mixture appropriate to the present invention is obtained when the Group I and Group II carrier fluids are combined in a Group I:Group II carrier fluid weight ratio of about 85:15, preferably about 75:25, with a weight ratio of about 50:50 being especially preferred. The preferred primary fluid mixtures of the present invention contain a Group I carrier fluid selected from the group consisting of the carrier fluid classes (h), (j), (k) and (m) mixed with a Group II carrier fluid selected from group consisting of the carrier fluid classes (a), (b), (d), (g), (h), (j), (k) or (m).

Although many of the carrier fluids selected from groups (f) and (g) exhibit acceptable $\Delta\eta/\Delta T$ ratios, they lack the necessary lubricating properties required by the present invention to insure a long life-time for a magnetorheological fluid device. Thus a limited number of carrier fluid mixtures appropriate to the present invention can also be obtained by mixing specific amounts of fluids selected from groups (f) and (g) that exhibit acceptable $\Delta\eta/\Delta T$ ratios with fluids selected from groups (a) through (e) and (h) through (n) that do not exhibit an appropriate $\Delta\eta/\Delta T$ ratio for purposes of the present invention. This particular mixture is hereinafter described as a secondary fluid mixture and carrier fluids falling within the classes (f) and (g) and exhibiting an appropriate $\Delta\eta/\Delta T$ ratio are hereinafter collectively referred to as Group III carrier fluids, while those carrier fluids falling within the classes (a) through (e) and (h) through (n) and not exhibiting an appropriate $\Delta\eta/\Delta T$ ratio are hereinafter collectively referred to as Group IV carrier fluids. Due to molecular interactions between the different fluids that make up the secondary fluid mixture, it has been discovered that it is possible for this fluid mixture, provided the fluids are properly selected, to unexpectantly exhibit a $\Delta\eta/\Delta T$ ratio that is less than the $\Delta\eta/\Delta T$ ratios of the individual fluids used in the preparation of the mixture. In general, a secondary fluid mixture appropriate to the present invention is obtained when the Group III and Group IV carrier fluids are combined in a Group III:Group IV carrier fluid weight ratio of about 85:15, preferably about 75:25, with a weight ratio of about 50:50 being especially preferred. The preferred secondary fluid mixtures of the present invention contain a Group III carrier fluid from class (g) mixed with a Group IV carrier fluid selected from the group consisting of classes (a), (b), (d), (h), (j), or (k).

The silicone oils, class (m), of the invention can be any polysiloxane, such as a silicone homopolymer or copolymer, comprising a siloxane polymeric backbone substituted with hydrocarbon radicals as side and end groups. The hydrocarbon radicals can be either straight chain, branched or cyclic, as well as aliphatic or aromatic with the number of carbon atoms ranging from 1 to about 8. In addition, the hydrocarbon radicals may contain H, N, O, S, Cl, Br and F functionality as in the case of fluorinated polysiloxanes. Examples of commercially available polysiloxanes include polydimethylsiloxanes, polymethylphenylsiloxanes, poly-(methyl3,3,3-trifluoropropyl) siloxanes, polychlorophenylmethylsiloxanes, dimethyl(tetrachlorophenyl)siloxane copolymers, dimethyl(phenylmethyl)siloxane copolymers, dimethyl(diphenyl)siloxane copolymers, and methyl3,3,3-trifluoropropyl(dimethyl)siloxane copolymers with polydimethylsiloxanes being preferred. In order for the preferred polydimethylsiloxanes to exhibit the appropriate $\Delta\eta/\Delta T$ ratio, they must exhibit a viscosity at 25° C. that is within the range of 2 to 200 centipoise, preferably 5 to 100 centipoise, with 10 to 50 centipoise being especially preferred.

The fluorinated ethers and esters, class (k), of the present invention can be any linear fluorinated polymers containing a polyether or polyester backbone consisting of carbon and oxygen atoms with either $CF_3$ or F functionality. The preferred fluorinated ethers of the invention are perfluorinated polyethers corresponding to the following formula:

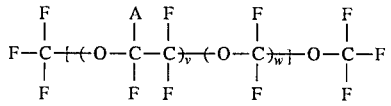

wherein A can be F or $CF_3$ and the ratio of v:w is between about 30:1 and 50:1, preferably between about 35:1 and 45:1. Examples of commercially available perfluorinated polyethers include both the GALDEN and FOMBLIN fluorinated liquids available from Montedison USA, Incorporated.

The glycol esters and ethers, class (j), of the present invention can be any propylene or ethylene glycol derivative containing the basic structure:

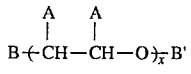

wherein A is H or $CH_3$; B is $CH_3$, H, OH, or $O_2CR$ with R being an alkyl or aryl group; and B' is H, $CH_3$ or C(O)R' with R' being an alkyl or aryl group. The basic repeating unit as described by x may range from about 1 to 8, preferably about 1 to 4. Examples of commercially available glycol esters and ethers include the DOWANOL liquids from Dow Chemical Co.; the BENZOFLEX liquids available from Velsicol Chemical Corporation; the ARCOSOLV liguids from ARCO Chemical Co.; the EKTASOLVE liquids from Eastman Kodak Co.; POLY-SOLV liquids from Olin Chemical Corporation; and the UCON, PROPASOL, CARBITOL and CELLOSOLVE liquids available from Union Carbide Corporation.

The unsaturated hydrocarbons, class (h), of the present invention can be any straight chain, branched or cyclic hydrocarbon which contains one or more carbon-carbon double or triple bonds. The unsaturated cyclic hydrocarbons appropriate to the present invention may or may not exhibit aromaticity. Examples of unsaturated hydrocarbons useful in the present invention include octene, nonene, decene, decadiene, butyl benzene, amyl benzene and toluene.

The unsaturated hydrocarbons of the present invention differ from the saturated hydrocarbons classified in classes (b) mineral oil and (g) synthetic cycloparaffins and synthetic paraffins. Saturated hydrocarbons are typically defined as straight chain, branched or cyclic hydrocarbons having all carbon-carbon single bonds. More specifically, saturated straight chain or branched hydrocarbons are termed paraffins, while saturated cyclic hydrocarbons are defined as cycloparaffins. Mineral oils, which are also known as white oils, are a mixture of paraffins and cycloparaffins obtained as a distillate of petroleum. Synthetic paraffins, which are also known as poly(olefins), are typically saturated hydrocarbons prepared through the controlled polymerization of ethylene and propylene. By definition, mineral oils is a subset of the larger class of paraffins. However, a difference in lubricating behavior demands that these two classes be differentiated, i.e., classes (b) and (g), in the present invention.

The main differentiating feature between the lubricating oil classes (b) mineral oils and (g) synthetic cycloparaffins and synthetic paraffins is that mineral oils usually exhibit higher molecular weight than their synthetic counterparts. Therefore, mineral oils typically exhibit excellent lubrication properties but have inappropriate $\Delta\eta/\Delta T$ ratios. On the other hand, the $\Delta\eta/\Delta T$ ratio exhibited by most oils classified in class (g) as synthetic cycloparaffins or synthetic paraffins are usually within an acceptable range, but these class (g) fluids exhibit unacceptable lubricating properties and therefore cannot be adequately used in the present invention. Unsaturated hydrocarbons classified in class (h), on the other hand, are well known to those skilled in the art of tribology to provide better wear protection than saturated hydrocarbons of comparable viscosity and therefore can be utilized in the present invention, provided they exhibit an appropriate $\Delta\eta/\Delta T$ ratio. Specific carrier fluids that are correctly classified in class (g) as synthetic cycloparaffins or synthetic paraffins include kerosene, mineral spirits and CONOCO LVT200 oil.

The carrier fluids appropriate to the present invention may be prepared by methods well known in the art and many are commercially available as described above. The viscosity of commercially available carrier fluids can, if needed, be reduced by techniques well known to those skilled in the art of manufacturing such compounds. Such techniques include thermal depolymerization at high temperatures and reduced pressures, as well as both acid and base depolymerization in the presence of an appropriate endblocking agent.

The carrier fluid of the present invention is typically utilized in an amount ranging from about 50 to 95, preferably from about 60 to 85, percent by volume of the total magnetorheological material. This corresponds to about 11 to 70, preferably about 15 to 41, percent by weight when the carrier fluid and particle of the magnetorheological material have a specific gravity of about 0.95 and 7.86, respectively.

It is imperative that the carrier fluids of the invention have a $\Delta\eta/\Delta T$ ratio less than or equal to about 16.0 centipoise/°C. over the temperature range of about 25° C. to −40° C., since carrier fluids having a $\Delta\eta/\Delta T$ ratio within this range have been found to impart unexpectedly superior temperature stability to a corresponding magnetorheological material. Specifically, the low viscosity magnetorheological materials of the present invention are capable of exhibiting significantly less variance in mechanical properties over a temperature range of about −40° C. to 150° C. than magnetorheological materials prepared with conventional carrier components. Therefore, devices (i.e., dampers, mounts, clutches, etc.) that utilize the magnetorheological materials of the invention exhibit a more constant force output over a broad temperature range than devices utilizing magnetorheological materials prepared with traditional carrier components.

The minimal variation in mechanical properties with respect to a change in temperature of the present magnetorheological materials is advantageous in that it allows for the design of smaller, more efficient devices in most applications. In addition, the magnetorheological materials of the invention allow a design engineer greater leeway in the ultimate geometry or shape of a device, as well as in methods to control the power consumption of a device. Finally, the lubricating nature of the carrier fluids of the present invention allows for improved life-time of the device by minimizing wear on individual components, such as dynamic or static seals.

The particle component of the magnetorheological material of the invention can be comprised of essentially any solid which is known to exhibit magnetorheological activity. Typical particle components useful in the present invention are comprised of, for example, paramagnetic, superparamagnetic or ferromagnetic compounds. Specific examples of particle components useful in the present invention include particles comprised of materials such as iron, iron alloys, iron oxide, iron nitride, iron carbide, carbonyl iron, chromium dioxide, low carbon steel, silicon steel, nickel, cobalt, and mixtures thereof. The iron oxide includes all known pure iron oxides, such as $Fe_2O_3$ and $Fe_3O_4$, as well as those containing small amounts of other elements, such as manganese, zinc or barium. Specific examples of iron oxide-include ferrites and magnetites. In addition, the particle component can be comprised of any of the known alloys of iron, such as those containing aluminum, silicon, cobalt, nickel, vanadium, molybdenum, chromium, tungsten, manganese and/or copper. Preferred iron alloys of the invention include iron-cobalt and iron-nickel alloys. The iron-cobalt alloys preferred for use in a magnetorheological fluid have an iron:cobalt ratio ranging from about 30:70 to 95:5, preferably ranging from about 50:50 to 85:15, while the iron-nickel alloys have an iron:nickel ratio ranging from about 90:10 to 99:1, preferably ranging from about 94:6 to 97:3. The iron alloys may contain a small amount of other elements, such as vanadium, chromium, etc, in order to improve the ductility and mechanical properties of the alloys. These other elements are typically present in an amount that is less than about 3.0% by weight. Examples of iron-cobalt alloys include HYPERCO (Carpenter Technology), HYPERM (F. Krupp Widiafabrik), SUPERMENDUR (Arnold Eng.) and 2V-PERMENDUR (Western Electric).

The particle component is typically in the form of a metal powder which can be prepared by processes well known to those skilled in the art. Typical methods for the preparation of metal powders include the reduction of metal oxides, grinding or attrition, electrolytic deposition, metal carbonyl decomposition, rapid solidification, or smelt processing. Various metal powders that are commercially available include straight iron powders, reduced iron powders, insulated reduced iron powders, cobalt powders, and various alloy powders, such as [48%]Fe/[50%]Co/[2%]V. The diameter of the particles utilized herein can range from about 0.1 to 500 μm, preferably from about 1.0 to 250 μm, with from about 1.0 to 50 μm being specifically preferred.

The particles may be encapsulated or covered by a surface barrier coating in order to prevent the growth of a contaminant layer that may degrade the magnetic properties of the particles. This barrier coating, which preferably encapsulates the entire particle, may be composed of a variety of materials including nonmagnetic metals, ceramics, thermoplastic polymeric materials, thermosetting polymers and combinations thereof. Examples of thermosetting polymers useful for forming a protective coating include polyesters, polyimides, phenolics, epoxies, urethanes, rubbers and silicones, while examples of thermoplastic polymeric materials include acrylics, cellulosics, polyphenylene sulfides, polyquinoxilies, polyetherimides and polybenzimidazoles. Typical nonmagnetic metals useful for forming a protective coating include refractory transition metals, such as titanium, zirconium, hafnium, vanadium, niobium, tantulum, chromium, molybdenum, tungsten, copper, silver, gold, and lead, tin, zinc, cadmium, cobalt-based intermetallic alloys, and nickel-based intermetallic alloys. Examples of ceramic materials useful for forming a protective coating include the carbides, nitrides, borides, and silicides of the refractory transition metals described above; nonmetallic oxides, such as $Al_2O_3$, $Cr_2O_3$, $ZrO_3$, $HfO_2$, $TiO_2$, $SiO_2$, BeO, MgO, and $ThO_2$; nonmetallic nonoxides, such as $B_4C$, SiC, BN, $Si_3N_4$, AlN, and diamond; and various cermets. The preferred particles of the present invention are straight iron powders, reduced iron powders, iron-cobalt alloys and iron-nickel alloys either with or without a surface barrier coating.

The particle component typically comprises from about 5 to 50, preferably about 15 to 40, percent by volume of the total magnetorheological material depending on the desired magnetic activity and viscosity of the overall material. This corresponds to about 30 to 89, preferably about 59 to 85, percent by weight when the carrier fluid and particle of the magnetorheological material have a spedtic gravity of about 0.95 and 7.86, respectively.

A surfactant to more adequately disperse the particle component in the carrier vehicle may also be optionally utilized in the magnetorheological fluid. Such surfactants include known surfactants or dispersing agents such as ferrous oleate and naphthenate, metallic soaps (e.g., aluminum tristearate and distearate), alkaline soaps (e.g., lithium and sodium stearate), sulfonates, phosphate esters, stearic acid, glycerol monooleate, sorbitan sesquioleate, stearates, laurares, fatty adds, fatty alcohols, and other surface active agents. In addition, the optional surfactant may be comprised of steric stabilizing molecules, including fluoroaliphatic polymeric esters and titanate, aluminate or zirconate coupling agents. The optional surfactant may be employed in an amount ranging from about 0.1 to 20 percent by weight relative to the weight of the particle component.

Particle settling may be minimized in the magnetorheological materials of the present invention by forming a thixotropic network. A thixotropic network is defined as a suspension of particles that, at low shear rates, form a loose network or structure sometimes referred to as clusters or fiocculates. The presence of this three-dimensional structure imparts a small degree of rigidity to the magnetorheological material, thereby reducing particle settling. However, when a shearing force is applied through mild agitation, this structure is easily disrupted or dispersed. When the shearing force is removed, this loose network is reformed over a period of time. A thixotropic network may be formed in the magnetorheological fluid of the present invention through the utilization of any known thixotropic additive such as hydrogen-bonding thixotropic agents and/or colloidal additives. The thixotropic agents and colloidal additives, if utilized, are typically employed in an amount ranging from about 0.1 to 5.0, preferably from about 0.5 to 3.0, percent by volume relative to the overall volume of the magnetorheological fluid.

Examples of hydrogen-bonding thixotropic agents useful in the present invention include low molecular weight hydrogen-bonding molecules containing hydroxyl, carboxyl or amine functionality, as well as medium molecular weight hydrogen-bonding molecules, such as silicone oligomers, organosilicone oligomers, and organic oligomers. Typical low molecular weight hydrogen-bonding molecules include alcohols; glycols; alkyl amines, amino alcohols, amino esters, and mixtures thereof. Typical medium molecular weight hydrogen-bonding molecules include oligomers containing sulphonated, amino, hydroxyl, cyano, halogenated, ester, carboxylic acid, ether, and ketone moieties, as well as mixtures thereof.

Examples of colloidal additives useful in the present invention include hydrophobic and hydrophilic metal oxide and high molecular weight powders. Examples of hydrophobic powders include surface-treated hydrophobic fumed silica and organo-clays. Examples of hydrophilic metal oxide or polymeric materials include silica gel, fumed silica, clays, and high molecular weight derivatives of caster oil, poly(ethyleneoxide), and poly(ethylene glycol).

The magnetorheological fluid of the invention may also contain other optional additives such as dyes or pigments, abrasive particles, lubricants, pH shifters, salts, deacidifiers, or corrosion inhibitors. These optional additives may be in the form of dispersions, suspensions, or materials that are soluble in the carrier vehicle.

The magnetorheological materials of the present invention can be prepared by initially mixing the ingredients together by hand (low shear) with a spatula or the like and then subsequently more thoroughly mixing (high shear) with a homogenizer, mechanical mixer or shaker or dispersing with an appropriate milling device such as a ball mill, sand mill, attritor mill, paint mill, colloid mill or the like, in order to create a more stable suspension.

Evaluation of the mechanical properties and characteristics of the magnetorheological materials of the present invention, as well as other magnetorheological materials, can be obtained through the use of parallel plate and/or concentric cylinder couette rheometry. The theories which provide the basis for these techniques are further described by S. Oka in *Rheology, Theory and Applications* (volume 3, F. R. Eirich, ed., Academic Press: New York, 1960). The information that can be obtained from a rheometer includes data relating mechanical shear stress as a function of shear strain rate. For magnetorheological materials, the shear stress versus shear strain rate data can be modeled after a Bingham plastic in order to determine the dynamic yield stress and viscosity. Within the confines of this model the dynamic yield stress for the magnetorheological material corresponds to the zero-rate intercept of a linear regression curve fit to the measured data. The viscosity of the material is defined as the slope of the line generated by this curve fitting technique. The magnetorheological effect at a particular magnetic field can be further defined as the difference between the dynamic yield stress measured at that magnetic field and the dynamic yield stress measured when no magnetic field is present.

In a concentric cylinder cell configuration the magnetorheological material is placed in the annular gap formed between an inner cylinder of radius $R_1$ and an outer cylinder of radius $R_2$, while in a simple parallel plate configuration the material is placed in the planar gap formed between upper and lower plates both with a radius, R3. In these techniques either one of the plates or cylinders is then rotated with an angular velocity $\omega$ while the other plate or cylinder is held motionless. A magnetic field is typically applied to these cell configurations across the fluid-filled gap, either radially for the concentric cylinder configuration, or axially for the parallel plate configuration. The relationship between the shear stress and the shear strain rate is then derived from this angular velocity and the torque, T, applied to maintain or resist it.

The testing of various application specific devices, such as dampers, mounts and clutches, that utilize either the magnetorheological materials of the present invention or other magnetorheological materials, is a second method of evaluating the mechanical performance of these materials. The magnetorheological material-containing device is simply placed in line with a mechanical actuator and operated with a specified displacement amplitude and frequency. A magnetic field is appropriately applied to the device and the force output determined from the resulting extension/compression waveforms plotted as a function of time. The methodology utilized to test dampers, mounts and clutches is well known to those skilled in the art of vibration control.

The following examples are given to illustrate the invention and should not be construed to limit the scope of the invention. In the examples, all viscosities are stated as being measured at a specific temperature and are given in centipoise.

EXAMPLES 1–9

The $\Delta\eta/\Delta T$ ratio for various Group I carrier fluids selected from the groups (h) through (n) are measured using conventional rheometry techniques in conjunction with a concentric cylinder or couette cell. The temperature of the carrier fluid is measured using a thermocouple in contact with the fluid through out the entire test. The $\Delta\eta/\Delta T$ ratio is defined as the viscosity measured for the carrier fluid at −40° C. minus the viscosity of the carrier fluid measured at 25° C., the sum of which is divided by 65° C. to yield a ratio given in units of centipoise/°C. The variance in the measurements obtained by this method is found by repetitive testing of several fluids to be about ±0.5 mPa-sec/°C. The $\Delta\eta/\Delta T$ ratios measured for carrier fluids appropriate to the present invention are summarized in Table 1.

TABLE 1

| Example # | Group Classification | Carrier Fluid Description | $\Delta\eta/\Delta T$ ratio |
|---|---|---|---|
| 1 | (i) mono-basic acid ester | propyl benzoate (#30,700-9, Aldrich Chemical Co.) | 5.5 |
| 2 | (j) glycol ester/ether | dipropylene glycol n-butyl ether (DOWANOL DPnB, Dow Chemical Company) | 3.5 |
| 3 | (j) glycol ester/ether | propylene glycol n-butyl ether (DOWANOL PnB, Dow Chemical Company) | 0.9 |
| 4 | (j) glycol ester/ether | copolymer of ethylene & propylene oxide (UCON 50-HB-55, Union Carbide Chemicals & Plastics Co., Inc.) | 15.9 |
| 5 | (k) fluorinated ester/ether | fluorinated polyether (GALDEN D02, Montedison USA, Inc.) | 0.5 |
| 6 | (k) fluorinated ester/ether | fluorinated polyether (GALDEN D10, Montedison USA, Inc.) | 11.2 |
| 7 | (m) silicone oil | polydimethylsiloxane (L-45, 10 cstk, Union Carbide Chemicals & Plastics Co., Inc.) | 0.6 |
| 8 | (m) silicone oil | polydimethylsiloxane (PS040, 50 cstk, Huls America Inc.) | 3.6 |
| 9 | (m) silicone oil | polydimethylsiloxane (L-45, 200 cstk, Union Carbide Chemicals & Plastics Co., Inc.) | 13.9 |

Examples 1–9 demonstrate that certain fluids within the main lubricating oils classes or groups (h) through (n) exhibit a $\Delta\eta/\Delta T$ ratio less than about 16 centipoise/°C. with preferred Group I fluids exhibiting a ratio less than about 9 centipoise/°C. and especially preferred Group I fluids having a ratio less than about 7 centipoise/°C. Examples 7–9 further establish the viscosity limit for polydimethylsiloxanes to be about 200 cstk in order to exhibit the necessary $\Delta\eta/\Delta T$ ratio.

COMPARATIVE EXAMPLES 10–22

The $\Delta\eta/\Delta T$ ratio for various Group II carrier fluids selected from within the lubricating oil groups (h through n) are measured using the procedure described for Examples 1–9. The $\Delta\eta/\Delta T$ ratios measured for these comparative carrier fluids are summarized in Table 2.

TABLE 2

| Example # | Group Classification | Carrier Fluid Description | $\Delta\eta/\Delta T$ ratio |
|---|---|---|---|
| 10 | (i) mono-basic acid ester | butyl benzoate (#29,329-6, Aldrich Chemical Co.) | *Thick |
| 11 | (j) glycol ester/ether | ethylene glycol phenyl ether (DOWANOL EPH, Dow Chemical Co.) | *Thick |
| 12 | (j) glycol | propylene glycol (#13,436-8, | 438.0 |

TABLE 2-continued

| Example # | Group Classification | Carrier Fluid Description | Δη/ΔT ratio |
|---|---|---|---|
| | ester/ether | Aldrich Chemical Co.) | |
| 13 | (j) glycol ester/ether | copolymer of propylene & ethylene oxide (UCON LB-65, Union Carbide Chemical & Plastics Co., Inc.) | 57.0 |
| 14 | (j) glycol ester/ether | copolymer of propylene & ethylene oxide (UCON 50-HB-100, Union Carbide Chemical & Plastics Co., Inc.) | 111.0 |
| 15 | (j) glycol ester/ether | copolymer of propylene & ethylene oxide (UCON LB-135, Union Carbide Chemical & Plastics Co., Inc.) | 437.0 |
| 16 | (k) fluorinated ether/ester | fluorinated polyether (GALDEN D20, Montedison USA, Inc.) | 60.0 |
| 17 | (k) fluorinated ether/ester | perfluorinated polyether (FOMBLIN L-VAC 25/6, Montedison USA, Inc.) | 483.0 |
| 18 | (l) silicate ester | tetraphenylsilicate (T2075, mp = 48° C., tetraphenoxysilane, Huls America Inc.) | **solid at low T |
| 19 | (m) silicone oil | polydimethylsiloxane (PS041.5, 350 cstk, Huls America Inc.) | 34.2 |
| 20 | (m) silicone oil | polymethylphenylsiloxane (PS160, 500 cstk, Huls America Inc.) | *Thick |
| 21 | (m) silicone oil | poly(methyl-3,3,3-trifluoropropyl)siloxane (FS1265, 300 cstk, Dow Corning Corp.) | *Thick |
| 22 | (n) halogenated hydrocarbons | chlorinated biphenyls: i.e., 4-chloro biphenyl (mp = 78° C.), 2-chloro biphenyl (mp = 34° C.), 3-chloro biphenyl (mp = 16° C.) | ***solid at low T |

*Fluid became too thick to test, thus Δη/ΔT ratio >>> 16
**data obtained from Huls America Inc.
***data obtained from CRC, 67th ed., 1986, page C-154

Examples 10–22 demonstrate that a considerable number of carrier fluids exist within the lubricating oil groups (h) through (n) that do not exhibit the necessary Δη/ΔT ratio for utilization as part of the present invention. A device utilizing a magnetorheological material containing these comparative carrier fluids will exhibit a large variation in force output when operated over a broad temperature range. Examples 18 and 22 demonstrate that specific carrier fluids, such as tetraphenylsilicate ester and chlorinated biphenyls of U.S. Pat. No. 2,751,352 that do not satisfy the necessary Δη/ΔT ratio as described by the present invention. Example 19 demontrates that a polydimethylsiloxane whose viscosity is greater than the limit of 200 cstk as previously described in Example 9 exhibits an unsatisfactory Δη/ΔT ratio.

COMPARATIVE EXAMPLES 23–33

The Δη/ΔT ratio for various Group II carrier fluids selected from within the lubricating oil groups (a) through (e) are measured using the procedure described for Examples 1–9 . The Δη/ΔT ratios measured for these comparative carrier fluids are summarized in Table 3.

TABLE 3

| Example # | Group Classification | Carrier Fluid Description | Δη/ΔT ratio |
|---|---|---|---|
| 23 | (d) dibasic acid ester | di(2-ethylhexyl) sebacate (#29,083-1 Aldrich Chemical Co.) | 26.0 |
| 24 | (d) dibasic acid ester | di(2-ethylhexyl) adipate (KODAFLEX DOA plasticizer, Eastman Chemical Co.) | 27.0 |
| 25 | (d) dibasic acid ester | di(octyl) pthalate (#D20,115-4, Aldrich Chemical Co.) | 43.0 |
| 26 | (d) dibasic acid ester | dibutyl sebecate (#24,047-8, Aldrich Chemical Co.) | *Thick |
| 27 | (d) dibasic acid ester | ethylRicinoleate (TCI, Japan) | *Thick |
| 28 | (b) mineral oils | white mineral oil (DRAKEOL 10B, 18 cstk, Penreco, Div. of Pennzoil Products Co.) | 179.0 |
| 29 | (b) mineral oils | hydraulic oil (MOBIL DTE-13M, 33 cstk, Mobil Oil Corp.) | 41.0 |
| 30 | (b) mineral oils | hydraulic oil (MOBIL DTE-11, 15 cstk, Mobil Oil Corp.) | 83.7 |
| 31 | (b) mineral oils | white, light mineral oil (#33,077-9, Aldrich Chemical Co.) | 38.9 |
| 32 | (b) mineral oils | white mineral oil (DRAKEOL 5, 8 cstk, Penreco, Div. of Pennzoil Products Co.) | *Thick |
| 33 | (b) mineral oils | mineral oil (#6081, Viscosity Oil Inc.) | 196.0 |

*Fluid became too thick to test, thus Δη/ΔT ratio >>> 16

Examples 23–33 demonstrate that carrier fluids selected from the lubricating oil groups (a) through (e) do not exhibit the necessary Δη/ΔT ratio to minimize force output of a magnetorheological material device when operated over a broad temperature range. These examples also demonstrate that most conventional carrier components in the lubricating oil groups (a) through (e) that have been previously described in the literature (e.g., U.S. Pat. No. 2,751,352) exhibit Δη/ΔT ratios that are outside the scope of the present invention.

EXAMPLES 34–40

The Δη/ΔT ratio for various primary and secondary fluid mixtures are measured using the procedure described for Examples 1–9. In Examples 34–37 various primary mixtures of fluorinated ethers group (k) are examined. In examples 34–37, one fluid, which exhibits the appropriate Δη/ΔT ratio and lubricating properties, selected from the Group I carrier fluids is mixed in specific amounts with a second fluid, which does not exhibit the necessary Δη/ΔT ratio, selected from the Group II carrier fluids.

In Examples 37–40 various secondary mixtures of fluids selected from groups (b), (d), and (g) are examined. In the case of secondary mixtures, one fluid, which is selected from the Group III carrier fluids, typically exhibits an acceptable Δη/ΔT ratio, but lacks the lubricity needed to prolong the useful life of a magnetorheological fluid device, while the second fluid, which is selected from the Group IV carrier fluids, exhibits excellent lubricity while lacking the necessary Δη/ΔT ratio to minimize performance variation with respect to temperature. The Δη/ΔT ratios measured for several primary and secondary fluid mixtures are summarized in Table 4.

TABLE 4

| Example # | Group Classification | Carrier Fluid Description | Δη/ΔT ratio |
|---|---|---|---|
| 34 | primary fluid mixture | 25% GALDEN D02 (group k, Δη/ΔT = 0.5, Example 5) and 75% GALDEN D20 (group k, Δη/ΔT = 60.0, Example 16) | 7.0 |
| 35 | primary fluid mixture | 50% GALDEN D02 and 50% GALDEN D20 | 4.1 |
| 36 | primary fluid mixture | 75% GALDEN D02 and 25% GALDEN D20 | 0.6 |
| 37 | secondary fluid mixture | 25% CONOCO LVT-200 (mixture of synthetic paraffins and cycloparaffins, group g, Δη/ΔT = 0.5, Conoco Inc.) and 75% di(2-ethylhexyl) sebecate (group d, Δη/ΔT = 26.0, Example 29) | 8.6 |
| 38 | secondary fluid mixture | 50% CONOCO LVT-200 and 50% di(2-ethylhexyl) sebecate | 2.7 |
| 39 | secondary fluid mixture | 75% CONOCO LVT-200 and 25% di(2-ethylhexyl)sebecate | 1.5 |
| 40 | secondary fluid mixture | Mixture of 50% #6098 oil (polyolefin or synthetic paraffin, group g, Δη/ΔT = 12.0, Viscosity Oil Inc.) and 50% #6081 oil (group b, Δη/ΔT = 196.0, Example 28) supplied as #6097 oil (Viscosity Oil Inc.) | 6.7 |

Examples 34–36 demonstrate that primary fluid mixtures that exhibit acceptable Δη/ΔT ratios can be obtained by mixing a carrier fluid selected from the Group I carrier fluids with a carrier fluid selected from the Group II carrier fluids. Between 25 and 75% by weight of a Group I carrier fluid is needed to insure that the primary fluid mixture exhibits acceptable lubricating properties. Examples 37–40 demonstrate that secondary fluid mixtures that exhibit acceptable Δη/ΔT ratios can be obtained by mixing a carrier fluid selected from the Group III carrier fluids with a carrier fluid selected from the Group IV carrier fluids. Between 25 to 75% by weight of a carrier fluid selected from the Group III carrier fluids is needed to insure that the secondary fluid mixture exhibits an acceptable Δη/ηT ratio. However, a minimum of 25% by weight of the carrier fluid selected from the Group IV carrier fluids is necessary to insure that the secondary fluid mixture exhibits acceptable lubricating properties.

Example 40 demonstrates that the secondary fluid mixture can unexpectedly exhibit a Δη/ΔT ratio that is smaller than the Δη/ΔT ratios measured for the individual fluids that are used to prepare the mixture. One would normally expect that the Δη/ΔT ratio of a fluid mixture would fall between the Δη/ΔT ratios exhibited by the individual fluids that make up the mixture. This result allows for some secondary fluid mixtures to exhibit improved lubricating properties by being able to incorporate a larger amount of the carrier fluids selected from the Group IV carrier fluids into the mixture without adversely affecting the Δη/ΔT ratio exhibited by the mixture.

COMPARATIVE EXAMPLES 41–43

The Δη/ΔT ratio for various carrier fluid mixtures wherein the carrier fluids are selected from within the fluid classes (a) through (n) are measured using the procedure described for Examples 1–9. The Δη/ΔT ratios measured for these comparative carrier fluids are summarized in Table 5.

TABLE 5

| Example # | Group Classification | Carrier Fluid Description | Δη/ΔT ratio |
|---|---|---|---|
| 41 | Comparative fluid mixture | 25% DRAKEOL 5 (Δη/ΔT >> 16, Example 27) and 75% di(2-ethylhexyl) sebecate (Δη/ΔT = 26.0, Example 29) | 47.0 |
| 42 | Comparative fluid mixture | 50% DRAKEOL 5 and 50% di(2-ethylhexyl) sebecate | 46.2 |
| 43 | Comparative fluid mixture | 75% DRAKEOL 5 and 25% di(2-ethylhexyl) sebecate | 47.3 |

Examples 41–43 demonstrate that if individual carrier fluids are not properly selected as previously defined for primary and secondary fluid mixtures the resulting carrier fluid mixture will not exhibit an appropriate Δη/ΔT ratio.

EXAMPLE 44

A magnetorheological material is prepared by adding together a total of 1257.6 g straight carbonyl iron powder (MICROPOWDER-S1640, which is similar to old E1 iron powder notation, from GAF Chemicals Corporation), 25.0 g Mn/Zn ferrite (#73302-0, D. M. Steward Manufacturing Company), 17.3 g siloxane oligomer-modified silica (CABOSIL TS720, Cabot Corporation) as a polymer-modified metal oxide, and 25.2 g of a phosphate ester dispersant (EMPHOS CS141, Witco Chemical Corporation) with 294.7 g polydimethylsiloxane oil (Example 7). The viscosity of the polydimethylsiloxane selected from group (m) is measured by concentric cylinder rheometry to be about 16 centipoise at 25° C. The magnetorheological material is made into a homogeneous mixture over a 16-hour period using an attritor mill. The material is stored in a polyethylene container until utilized.

COMPARATIVE EXAMPLE 45

A magnetorheological material is prepared according to the procedure described in Example 44. However, in this example the 16 centipoise polydimethylsiloxane oil is replaced with a higher viscosity silicone oil (PS042, 500 centistoke, Huls America Inc.). The viscosity of this silicone oil selected from group (m) is measured by concentric cylinder rheometry to be about 660 centipoise at 25° C. The magnetorheological material is stored in a polyethylene container until utilized.

Mechanical Porperties of Examples 44 and 45

The mechanical performance of the magnetorheological materials prepared in Examples 44 and 45 are evaluated in a linear magnetorheological damper over a temperature range of −40° to 150° C. More specifically, this damper contains approximately 250 mL of a magnetorheological material that is forced to flow by the movement of a piston. A magnetic field is generated and controlled across a gap within the device through the application of electric current to an electromagnetic coil contained within the piston. The width of this gap through which the fluid flows is about 1.5 mm. During the tests the damper is operated at a frequency of 1.0 Hz with a displacement amplitude of ±0.5 inch. A magnetic field is appropriately applied to the device and the force output determined from the resulting extension/compression waveforms plotted as a function of time.

The force output of this linear damper utilizing a low viscosity magnetorheological material of the present invention (Example 44) is compared in FIG. 1 to the force output of this same damper using a high viscosity comparative magnetorheological material (Example 45). In this figure the measured force data at a magnetic field of about 1000 Oersted is plotted as a function of temperature. The damper utilizing a magnetorheological material of the invention is observed to provide a relatively constant (less than about 15% variation) force output over the temperature range of –40° to 150° C., while the force output of this same damper varies by greater than about 70% over this temperature range when the comparative magnetorheological material of Example 45 is utilized.

EXAMPLE 46

A magnetorheological material is prepared by adding together a total of 235.80 g straight carbonyl iron powder (MICROPOWDER-S1640, GAF Chemicals Corporation) and 6.90 g siloxane oligomer-modified silica (CABOSIL TS 720, Cabot Corporation) as a thixotrope with 56.01 g secondary fluid mixture (#6097 oil, Example ). The weight amount of iron particles in this magnetorheological material corresponds to a volume fraction of 0.30. The secondary fluid mixture exhibits a $\Delta\eta/\Delta T$ ratio of 6.7 centipoise/°C. over the temperature range of 25° C. to –40° C. The magnetorheological material is made into a homogeneous mixture through the use of a high speed mechanical disperser. The material is stored in a polyethylene container until utilized.

EXAMPLE 47

A magnetorheological material is prepared according to the procedure described in Example 46. However, in this example 235.80 g straight carbonyl iron powder (MICROPOWDER-S-1640, GAF Chemicals Corporation) is added to 129.50 g perfluorinated polyether (Galden D 10, Montedison USA, Inc.). The weight amount of iron particles in this magnetorheological material corresponds to a volume fraction of 0.30. The carrier fluid selected from group (k) has a $\Delta\eta/\Delta T$ ratio of 11.2 centipoise/°C. over the temperature range of 25° C. to –40° C. The magnetorheological material is stored in a polyethylene container until utilized.

EXAMPLE 48

A magnetorheological material is prepared according to the procedure described in Example 46. However, in this example 235.80 g straight carbonyl iron powder (MICROPOWDER-S-1640, GAF Chemicals Corporation) is added to 71.82 g propyl benzoate (#30,700-9, Aldrich Chemical Company). The weight amount of iron particles in this magnetorheological material corresponds to a volume fraction of 0.30. The carrier fluid selected from group (i) has a $\Delta\eta/\Delta T$ ratio of 5.5 centipoise/°C. over the temperature range of 25° C. to –40° C. The magnetorheological material is stored in a polyethylene container until utilized.

COMPARATIVE EXAMPLE 49

A magnetorheological material is prepared according to the procedure described in Example 46. However, in this example 235.80 g straight carbonyl iron powder (MICROPOWDER-S-1640, GAF Chemicals Corporation) and 6.90 g siloxane oligomer-modified silica (CABOSIL TS-720, Cabot Corporation) as a thixotrope are added to 56.08 g white mineral oil (Example 27). The weight amount of iron particles in this magnetorheological material corresponds to a volume fraction of 0.30. The carrier fluid selected from group (b) has a $\Delta\eta/\Delta T$ ratio that is significantly greater than 16.0 centipoise/°C. over the temperature range of 25° C. to –40° C. The magnetorheological material is stored in a polyethylene container until utilized.

COMPARATIVE EXAMPLE 50

A magnetorheological material is prepared according to the procedure described in Example 46. However, in this example 235.80 g straight carbonyl iron powder (MICROPOWDER-S-1640, GAF Chemicals Corporation) is added to 133.00 g perfluorinated polyether (Example 17). The weight amount of iron particles in this magnetorheological material corresponds to a volume fraction of 0.30. The carrier fluid selected from group (k) has a $\Delta\eta/\Delta T$ ratio of 483.0 centipoise/°C. over the temperature range of 25° C. to –40° C. The magnetorheological material is stored in a polyethylene container until utilized.

COMPARATIVE EXAMPLE 51

A magnetorheological material is prepared according to the procedure described in Example 46. However, in this example 235.80 g straight carbonyl iron powder (MICROPOWDER-S-1640, GAF Chemicals Corporation) is added to 70.70 g butyl benzoate (Example 10). The weight amount of iron particles in this magnetorheological material corresponds to a volume fraction of 0.30. The carrier fluid selected from group (i) has a $\Delta\eta/\Delta T$ ratio that is significantly greater than 16.0 centipoise/°C. over the temperature range of 25° C. to –40° C. The magnetorheological material is stored in a polyethylene container until utilized.

Mechanical Properties of Examples 46 and 49

The mechanical performance of the magnetorheological materials prepared in Example 46 and comparative Example 49 are evaluated in a linear magnetorheological damper over a temperature range of –40° to 50° C. More specifically, this damper contains approximately 50 mL of a magnetorheological material that is forced to flow by the movement of a piston. A magnetic field is generated and controlled across a gap within the device through the application of electric current to an electromagnetic coil contained within the piston. The width of this gap through which the fluid flows is about 1.5 mm. During the tests the damper is operated at a frequency of 1.0 Hz with a displacement amplitude of ±0.5 inch. A magnetic field is appropriately applied to the device and the force output determined from the resulting extension/compression waveforms plotted as a function of time.

Figure 2:
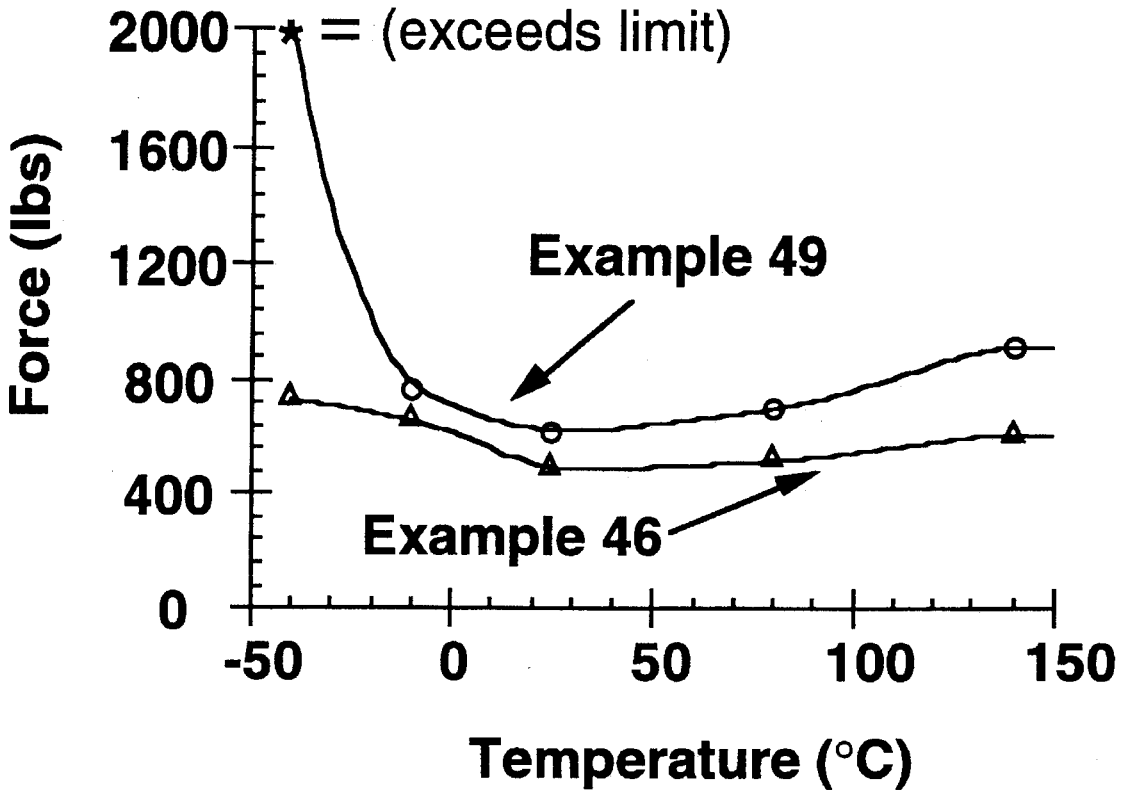

The force output of the linear damper utilizing the low viscosity magnetorheological material of the present invention (Example 46) is compared in FIG. 2 to the force output of this same damper using a comparative magnetorheological material (Example 49). In this figure the measured force data at a magnetic field of about 1000 Oersted is plotted as a function of temperature. The damper utilizing the magnetorheological material of the invention is observed to provide a relatively constant (less than about 34% variation) force output over the temperature range of –40° to 150° C., while the force output of this same damper varies by greater than about 69% over this temperature range when the comparative magnetorheological material of Example 49 is utilized. In fact, when the comparative magnetorheological material (Example 49) is utilized, the maximum force limit (safe operating limit) of the damper is exceeded at low temperatures.

Mechanical Properties of Examples 47 and 50

Figure 3:
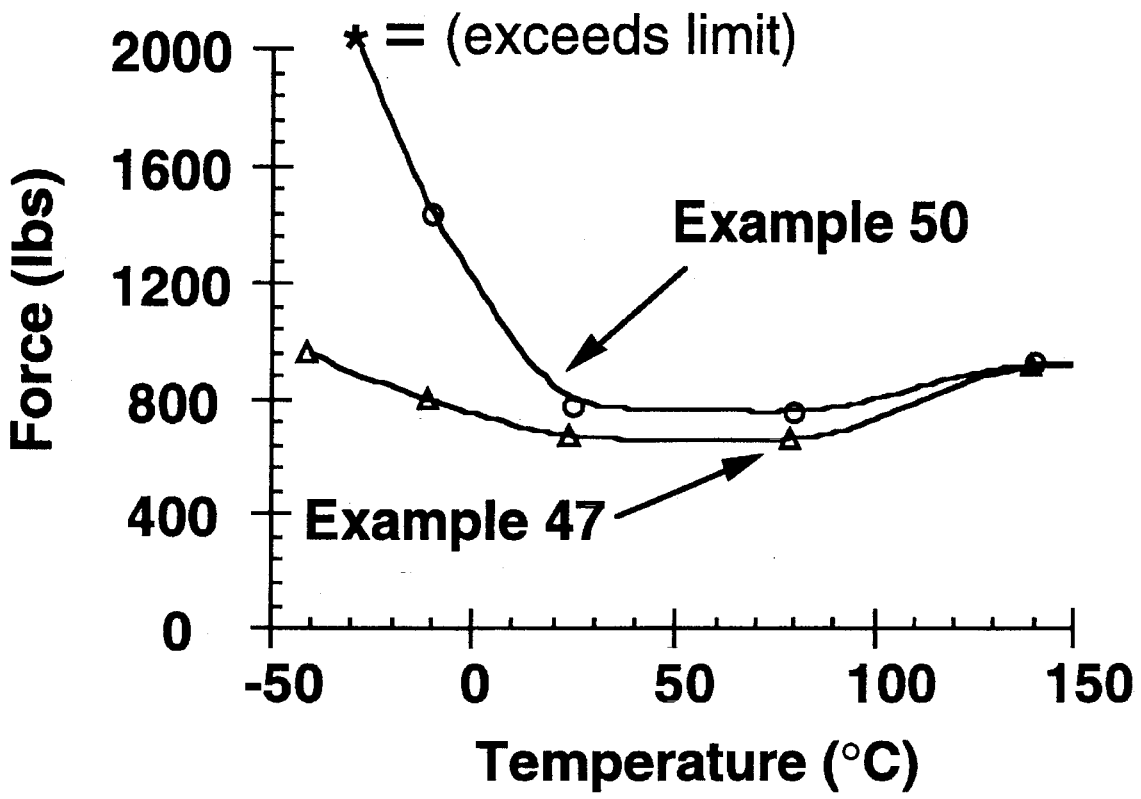

The mechanical properties of Examples 47 and 50 are evaluated by the procedure previously described for Examples 46 and 49. The force output of the linear damper utilizing the low viscosity magnetorheological material of the present invention (Example 47) is compared in FIG. 3 to the force output of this same damper using a comparative magnetorheological material (Example 50). In this figure the measured force data at a magnetic field of about 1000 Oersted is plotted as a function of temperature. The damper utilizing the magnetorheological material of the invention is observed to provide a relatively constant (less than about 30% variation) force output over the temperature range of –40° to 150° C., while the force output of this same damper varies by greater than about 61% over this temperature range when the comparative magnetorheological material of Example 50 is utilized. In fact, when the comparative magnetorheological material (Example 50) is utilized, the maximum force limit (safe operating limit) of the damper is exceeded at low temperatures.

Mechanical Properties of Examlpes 47 and 51

Figure 4:
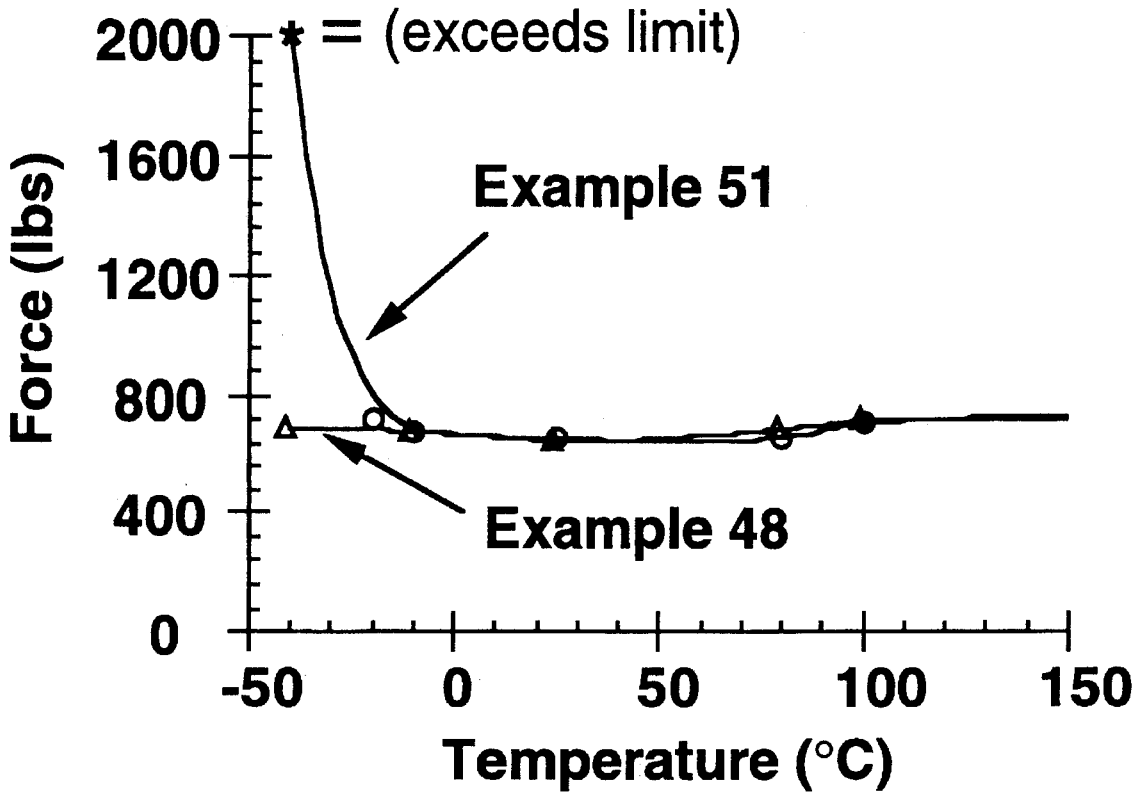

The force output of the linear damper utilizing the low viscosity magnetorheological material of the present invention (Example 47) is compared in FIG. 4 to the force output of this same damper using a comparative magnetorheological material (Example 51). In this figure the measured force data at a magnetic field of about 1000 Oersted is plotted as a function of temperature. The damper utilizing the magnetorheological material of the invention is observed to provide a relatively constant (less than about 11% variation) force output over the temperature range of –40° to 150° C., while the force output of this same damper varies by greater than about 67% over this temperature range when the comparative magnetorheological material of Example 51 is utilized. In fact, when the comparative magnetorheological material (Example 51) is utilized, the maximum force limit (safe operating limit) of the damper is exceeded at low temperatures.

Magnetorheological Effect Exhibited by Examples 44–51

The mechanical properties of the magnetorheological materials prepared in Examples 44–51 are further evaluated through the use of parallel plate rheometry. All the magnetorheological materials are observed to similarly exhibit significant dynamic yield stress values at 25° C. at various magnetic field strengths. For example, dynamic yield stress values of 43 and 52 kPa were measured for the magnetorheological material of Example 47 at magnetic field strengths of 2000 and 3000 Oersted, respectively. The dynamic yield stress value is defined as the y-intercept of a linear regression curve fit to the shear stress versus strain rate data obtained from the rheometer. A measure of the magnetorheological effect exhibited by a material is the difference that exists between the dynamic yield stress values observed in the presence of a magnetic field (on-state) and the yield stress value observed in the absence of a magnetic field (off-state). The off-state, dynamic yield stress values for the magnetorheological materials of Examples 44–51 are measured to be less than 1 kPa.

As can be seen from the above examples, the magnetorheological materials of the present invention exhibit significant magnetorheological activity and are capable of exhibiting stable performance over a temperature range of –40° to 150° C. The consistent performance of the present materials at the diverse temperatures described above is unexpected in light of the highly variable performance of traditional magnetorheological materials under similar diverse temperature conditions.

It is understood that the foregoing is a description of the preferred embodiments of the present invention and that the scope of the invention is not limited to the specific terms and conditions set forth above but is determined by the following claims.

What is claimed is:

1. A magnetorheological material comprising:

a) a carrier fluid selected from the group consisting of silicon oils and having a $\Delta\eta/\Delta T$ ratio less than or equal to about 16 centipoise/°C. over a temperature range of about –40° to 25° C.; and, b) a particle component wherein said particle component consists of particles having diameters from about 1.0 to 250 microns and having magnetorheological activity, wherein said magnetorheological material exhibits minimal variation in force output over a temperature range from about –40° C. to 150° C.

2. A magnetorheological material according to claim 1 wherein said silicone oils are selected from the group consisting of polydimethylsiloxanes, polymethylphenylsiloxanes, poly(methyl-3,3,3-trifluoropropyl)siloxanes, polycholorophenylmethylsiloxanes, dimethyl(tetrachlorophenyl) siloxane copolymers, dimethyl(phenylmethyl)siloxane copolymers, dimethyl(diphenyl)siloxane copolymers, and methyl-3,3,3-trifiuoropropyl (dimethyl )siloxane copolymers.

3. A magnetorheological material according to claim 1 wherein the $\Delta\eta/\Delta T$ ratio is less than or equal to about 9 centipoise/°C.

4. A magnetorheological material according to claim 3 wherein the $\Delta\eta/\Delta T$ ratio is less than or equal to about 7 centipoise/°C.

5. A magnetorheological material according to claim 1 wherein the particle component is selected from the group consisting of iron, iron alloys, iron oxide, iron nitride, iron carbide, carbonyl iron, chromium dioxide, low carbon steel, silicon steel, nickel, cobalt, and mixtures thereof.

6. A magnetorheological material according to claim 1 wherein the particle component is covered by a surface barrier coating.

7. A magnetorheological material according to claim 6 wherein the barrier coating is composed of a material selected from the group consisting of nonmagnetic metals, ceramics, thermoplastic polymeric materials, thermosetting polymers and combinations thereof.

8. A magnetorheological material according to claim 1 further comprising a surfactant.

9. A magnetorheological material according to claim 1 further comprising a thixotropic additive selected from the group consisting of hydrogen bonding thixotropic agents and colloidal additives.

10. A magnetorheological material according to claim 1 wherein the carrier fluid is present in an amount ranging from about 50 to 95 percent by volume and the particle component is present in an amount ranging from about 5 to 50 percent by volume of the total magnetorheological material.

11. A magnetorheological material according to claim 10 wherein the carrier fluid is present in an amount from about 60 to 85 percent by volume and the particle component is present in an amount from about 15 to 40 percent by volume of the total magnetorheological material.

12. The magnetorheological material of claim 1 wherein said particle component consists of particles having diameter from about 1.0 to 50 microns.

13. A magnetorheological material according to claim 1 wherein said silicon oil has a viscosity within the range of 20 to 200 centipoise at 25° C.

14. A magnetorheological material comprising:

a) a carrier fluid selected from the group consisting of glycol esters and ethers and having a $\Delta\eta/\Delta T$ ratio less than or equal to about 16 centipoise/°C. over a temperature range of about –40° C. to 25° C. and, b) a particle component wherein said particle component consists of particles having diameters from about 1.0 to 250 microns and having magnetorheological activity, wherein said magnetorheological material exhibits minimal variation in force output over a temperature range from about –40° C. to 150° C.

15. A magnetorheological material according to claim 1 wherein the glycol esters and ethers are propylene or ethylene glycol derivatives containing the basic structure:

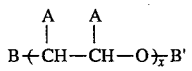

wherein A is H or $CH_3$; B is $CH_3$, H, OH, or $O_2CR$ with R being an alkyl or aryl group; B' is H, $CH_3$ or C(O)R' with R' being an alkyl or aryl group; and x ranges from about 1 to 8.

16. A magnetorheological material comprising:

a) a carrier fluid selected from the group consisting of monobasic acid esters and having a $\Delta\eta/\Delta T$ ratio less than or equal to about 16 centipoise/°C. over a temperature range of about –40° to 25° C. and, b) a particle component wherein said particle component consists of particles having diameters from about 1.0 to 250 microns and having magnetorheological activity, wherein said magnetorheological material exhibits minimal variation in force output over a temperature range from about –40° C. to 150° C.

17. A magnetorheological material comprising:

a) a carrier fluid selected from the group consisting of silicate esters and having a $\Delta\eta/\Delta T$ ratio less than or equal to about 16 centipoise/°C. over a temperature range of about –40° to 25° C. and, b) a particle component wherein said particle component consists of particles having diameters from about 1.0 to 250 microns and having magnetorheological activity, wherein said magnetorheological material exhibits minimal variation in force output over a temperature range from about –40° C. to 150° C.

18. A magnetorheological material comprising:

a) a mixture of carrier fluids wherein the mixture of carrier fluids has a $\Delta\eta/\Delta T$ ratio less than or equal to about 16 centipoise/°C. over a temperature range of about –40° C. to 25° C.; and, b) a particle component wherein said particle component consists of particles having diameters from about 1.0 to 250 microns and having magnetorheological activity, wherein said magnetorheological material exhibits minimal variation in force output over a temperature range from about –40° C. to 150° C.

19. A magnetorheological material according to claim 18 wherein said mixture of carrier fluids consists of a mixture of a Group I carrier fluid selected from the group consisting of unsaturated hydrocarbon oils, glycol esters and ethers, fluorinated esters and ethers, and silicone oils and a Group II carrier fluid selected from the group consisting of natural fatty oils, mineral oils, dibasic acid esters, synthetic cycloparaffins and synthetic paraffins, unsaturated hydrocarbon oils, glycol esters and ethers, fluorinated esters and ethers and silicone oils, said Group II carrier fluid having a $\Delta\eta/\Delta T$ ratio greater than about 16 centipoise/°C. over a temperature range from about –40° C. to 25° C.

20. A magnetorheological material according to claim 19 wherein the Group I and Group II carrier fluids are present in a Group I:Group II weight ratio of about 85:15.

21. A magnetorheological material according to claim 20 wherein the ratio is about 75:25.

22. A magnetorheological material according to claim 21 wherein the ratio is about 50:50.

23. A magnetorheological material according to claim 18 wherein said mixture of carrier fluids consists of a mixture of a Group III carrier fluid selected from the group consisting of synthetic cycloparaffins and synthetic paraffins and a Group IV carrier fluid selected from the group consisting of natural fatty oils, mineral oils, dibasic acid esters, unsaturated hydrocarbon oils, glycol esters and ethers, and fluorinated esters and ethers.

24. A magnetorheological material according to claim 23 wherein the Group III and Group IV carrier fluids are present in a Group III:Group IV weight ratio of about 85:15.

25. A magnetorheological material according to claim 24 wherein the ratio is about 75:25.

26. A magnetorheological material according to claim 25 wherein the ratio is about 50:50.

* * * * *